US005716153A

United States Patent [19]

Aiello

[11] Patent Number: 5,716,153

[45] Date of Patent: Feb. 10, 1998

[54] SAFETY RING BINDER

[75] Inventor: Justin Aiello, Norwalk, Conn.

[73] Assignee: Saf-T Ring, LLC, Linwood, N.J.

[21] Appl. No.: 553,991

[22] Filed: Nov. 6, 1995

[51] Int. Cl.[6] ..... B42F 3/02

[52] U.S. Cl. ..... 402/46

[58] Field of Search ..... 402/56, 31, 46, 402/52, 54, 55, 73; 281/36

[56] References Cited

U.S. PATENT DOCUMENTS

| | | | |
|---|---|---|---|
| 1,758,327 | 5/1930 | Lotten | 402/56 |
| 2,024,461 | 12/1935 | Lotten | 402/56 X |
| 2,104,046 | 1/1938 | Knag | 402/56 X |
| 2,212,380 | 8/1940 | Steele | 402/56 |
| 2,440,945 | 5/1948 | Hanna | 402/56 |
| 3,950,107 | 4/1976 | Seaborn . | |
| 3,954,343 | 5/1976 | Thomsen . | |
| 4,130,368 | 12/1978 | Jacoby et al. . | |
| 4,941,804 | 7/1990 | Sarpy, Jr. . | |
| 5,018,896 | 5/1991 | Vanni . | |
| 5,028,159 | 7/1991 | Amrich et al. . | |

*Primary Examiner*—Willmon Fridie, Jr.

*Attorney, Agent, or Firm*—Jacobson, Price, Holman & Stern, PLLC

[57] ABSTRACT

A two piece binder assembly with one piece adapted to be rivetted to the spine of a binder. The other piece is laterally slidable with respect to the fixed binder piece so as to engage the fixed binder piece and become, upon initial assembly, permanently secured to the fixed binder piece. The slidable piece is then movable between an open and a closed position by movement in a lateral direction which is perpendicular to the longitudinal axes of both pieces of the two piece binder assembly. The slidable piece is movable towards the fixed piece until the opposed fingers of the fixed and slidable pieces engage each other. At this point the slidable piece is secured to the fixed piece by the engagement of two hooked locking members with at least one hooked locking member becoming temporarily deformed until passing over the other hooked locking member and then snapping into place due to the resilient nature of the plastic material used so as to fixedly engage the two hooked locking members. Supplemental portions of the fixed and slidable piece slidingly engage each other to guide the slidable piece with respect to the fixed piece for aligned sliding of one piece with respect to the other.

16 Claims, 3 Drawing Sheets

2
2
7
7
8
8
9
9
10
10
20
22
24
26
28
30
32
34
36
38
40
42
44
46
50
52
54
56
57
58
60
62
64
66
96
100

SAFETY RING BINDER

FIELD OF THE INVENTION

This invention relates to the field of plastic ring binders for notebooks.

BACKGROUND OF THE INVENTION

Prior attempts to form a plastic loose leaf binder ring assembly have included a large number of moving parts having intricate movements. For example, in U.S. Pat. No. 3,954,343 to Thomsen, a looseleaf binder ring assembly includes a backbone formed of a resilient plastic material having a plurality of pairs of cooperating fingers formed thereon. Fingers of each pair face one another and are moveable between an open and closed position with respect to each other. A slidably mounted actuator bar is provided internally of the backbone. The actuator bar has cam surfaces for opening and closing the fingers when the actuator bar is moved along the longitudinal axis of the backbone. The cam surfaces hold their associated spring fingers in their open or closed position in accordance with the longitudinal movement of the actuator bar with respect to the backbone.

In U.S. Pat. No. 4,130,368 to Jacoby et al, a similar loose leaf binder ring assembly is disclosed having the fingers mounted in the backbone being located in specially formed recesses which prevent inadvertent removal of the fingers from the backbone. Again, an actuator bar is movable longitudinally with respect to the backbone for opening and closing the fingers when the actuator bar is moved between first and second positions. The cam surfaces of the actuator bar hold the associated fingers in opened and closed positions.

In both patents, the movement of the actuator bar causes the opposed pairs of fingers to move towards or away from each other with the fingers being pivotally anchored in the backbone. The cam surfaces of the actuator bar serve to effectively lock the fingers in their closed position against inadvertent opening thereof during use of the binder assembly. Therefore, the manual opening of the binder by grabbing opposed fingers as is the customary practice with standard metal ring binders, is prevented by the teachings of the Thomsen and Jacoby et al patents.

Other examples of binder assemblies are disclosed in U.S. Pat. No. 5,018,896 to Vanni, U.S. Pat. No. 5,028,159 to Amrich et al, U.S. Pat. No. 3,950,107 to Seaborn and U.S. Pat. No. 4,941,804 to Sarpy, Jr.

SUMMARY OF THE INVENTION

Accordingly, it is an object of the present invention to provide a plastic ring binder which is openable by grasping opposed fingers of the binder assembly.

It is another object of the present invention to provide a two piece plastic binder assembly which is actuable by a lateral movement of one of the two pieces with respect to the other piece in a direction perpendicular to the longitudinal axes of the two pieces so as to separate opposed fingers of the binder assembly by grasping the opposed fingers of the binder assembly. Preferably, two middle opposed fingers of the binder assembly are grasped by the operator to separate the two pieces of the binder assembly.

It is still yet another object of the present invention to have a two piece binder assembly with the two pieces slidable towards each other to lock the two pieces together and upon further movement of the two pieces towards each other, obtaining engagement of three sets of opposed fingers to form a loop for retaining papers and other three hole punched material within the binder assembly.

These objects and others are achieved by providing a two piece binder assembly with one piece adapted to be rivetted to the spine of a binder. The other piece is laterally slidable with respect to the fixed binder piece so as to engage the fixed binder piece and become, upon initial assembly, permanently secured to the fixed binder piece. The slidable piece is then movable between an open and a closed position by movement in a lateral direction which is perpendicular to the longitudinal axes of both pieces of the two piece binder assembly.

The slidable piece is movable towards the fixed piece until the opposed fingers of the fixed and slidable pieces engage each other. At this point the slidable piece is secured to the fixed piece by the engagement of two hooked locking members with at least one hooked locking member becoming temporarily deformed until passing over the other hooked locking member and then snapping into place due to the resilient nature of the plastic material used so as to fixedly engage the two hooked locking members. Supplemental portions of the fixed and slidable piece slidingly engage each other to guide the slidable piece with respect to the fixed piece for aligned sliding of one piece with respect to the other.

The natural tendency to open a typical metal binder assembly is to grasp the opposed fingers of the center ring and pull outwardly on these fingers. According to the principles of the present invention, a similar maneuver is used to separate the plastic slidable piece from the plastic fixed piece of the two piece plastic binder assembly of the present invention.

When the opposed fingers of a center ring are grasped and pulled in opposite directions, the "give" or resiliency of the plastic component elements allows the disengagement of the two hooked locking member so as to allow the sliding of the slidable element with respect to the fixed element and thereby open the three rings formed by the three sets of opposed fingers. The slidable element is slid laterally away from the fixed element until projections from the undersurface of the slidable element engage stops of the fixed element to prevent further sliding of the slidable element away from the fixed element. Lateral displacement of the slidable element is thereby limited to a predetermined amount for insertion of papers or other materials around the fingers of the rings of the binder assembly. The slidable element is slid laterally towards the fixed element until the respective hooked locking members engage each other and lock the pairs of opposed binder ring fingers together.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figures 1, 2, 3:
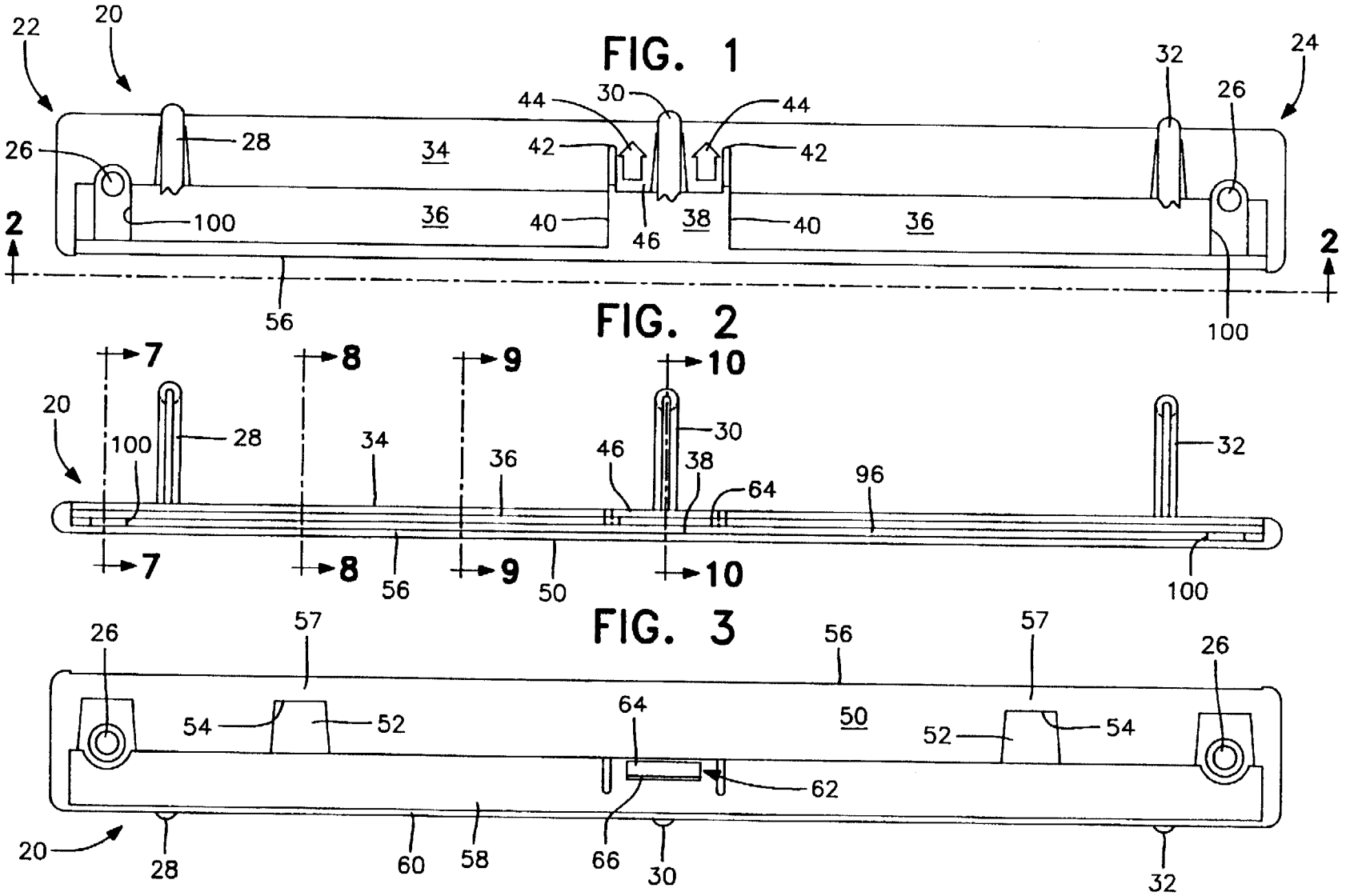
FIG. 1 is a top plan view of the fixed base element of the two piece plastic binder assembly of the present invention.
FIG. 2 is a side view of the fixed base element looking in the direction of line 2—2 of FIG. 1.
FIG. 3 is a bottom view of the fixed base element.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 6, in particular, a ring binder embodying the teachings of the subject invention is disclosed. The ring binder is made of only two pieces. These pieces are made of an injection molded plastic. The plastic material provides a light-weight, economical alternative to the use of metal and reduces the possibility of the user being cut by sharp metal edges.

With reference to the drawings, and FIGS. 1 through 3 in particular, a fixed base element 20 is shown. In one embodiment, according to the principles of the present invention, the fixed base element is approximately 10½ inches long by approximately 1.1 inches wide. Alternative dimensions may be used as it is contemplated as being within the scope of the present invention that all known notebooks may take advantage of the principles of the present invention.

At opposite ends 22 and 24 of base element 20 are located through holes 26 through which a rivet is passed to secure the fixed base element to a binder or notebook. This connection is a permanent connection for maintaining the base element in a fixed orientation with respect to the binder or notebook.

Spaced along the base element 20 are three curved binder fingers 28, 30 and 32. These fingers are formed integral with the base element 20 during the injection molding of the base element. The spacing between adjacent fingers is made to accommodate three ring hole punched paper or material having a corresponding spacing between holes.

The three fingers 28, 30 and 32 are located on a raised ridge portion 34 of the base element 20. Ridge portion 34 is formed stepped upwardly from ledges 36 and a successively lower track 38 defined by sidewalls 40 of ledges 36.

On the opposite sides of center finger 30 are two elongated cutouts 42 which define platform 46 and provide flexibility of movement of the center finger 30 due to the inherent "give" of plastic materials, for example in a combined lifting and lateral movement of finger 30 in the direction of arrows 44. An undercut locking member omitted from FIG. 1 for purposes of clarity has a hooked extension and is located below the center finger 30 in the platform 46 which is defined by the cutouts 42 on the lateral edges of the platform.

In FIG. 3, the lowermost bottom surface 50 includes cutouts 52 to define stop edges 54 adjacent to side edge 56 of the base element 20. Strip portion 57 is located between stop edge 54 and side edge 56. In addition, there is a cutout portion 58 limited by peripheral border 60 through which is seen locking member 62, located on the underside of platform 46, having ramp 64 and hook edge 66.

Figure 4:
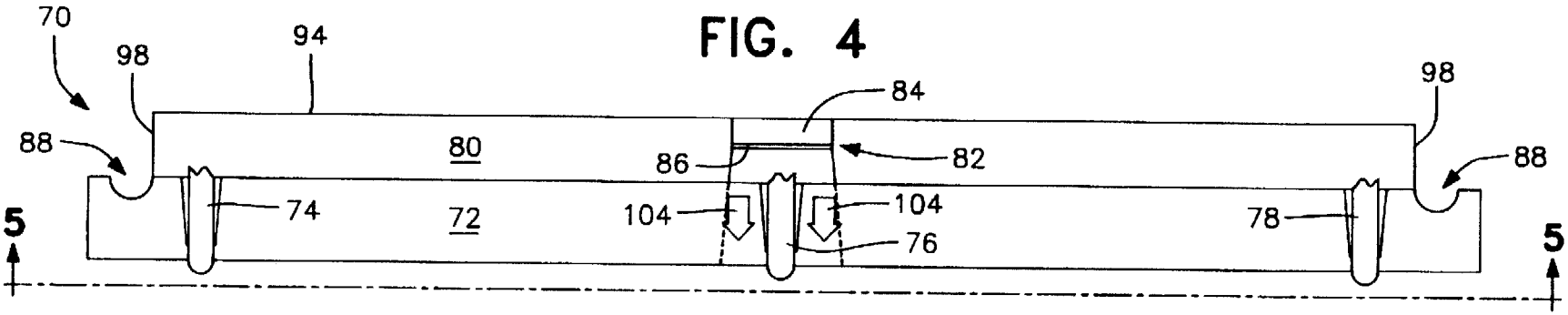
FIG. 4 is a top plan view of the movable slide element of the two piece plastic binder assembly in accordance with the principles of the present invention.
Figure 5:
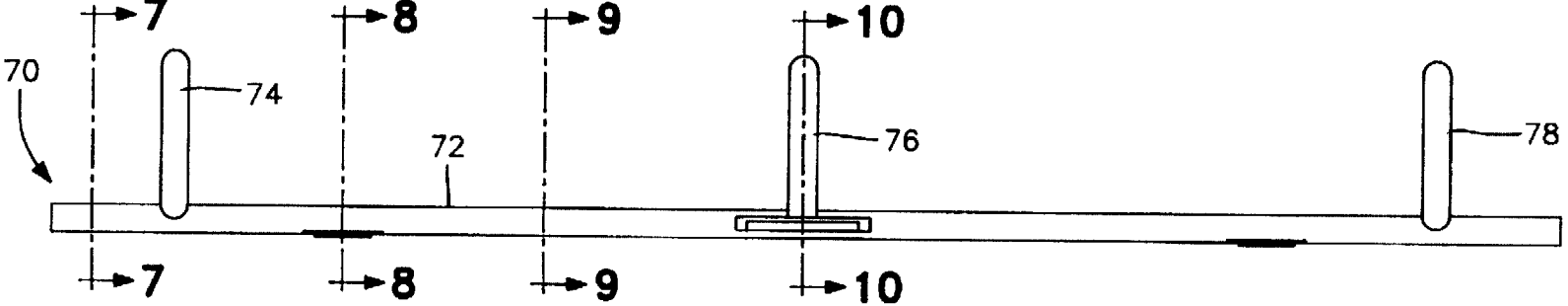
FIG. 5 is a side view of the movable slide element looking in the direction of line 5—5 of FIG. 4.
Figure 6:
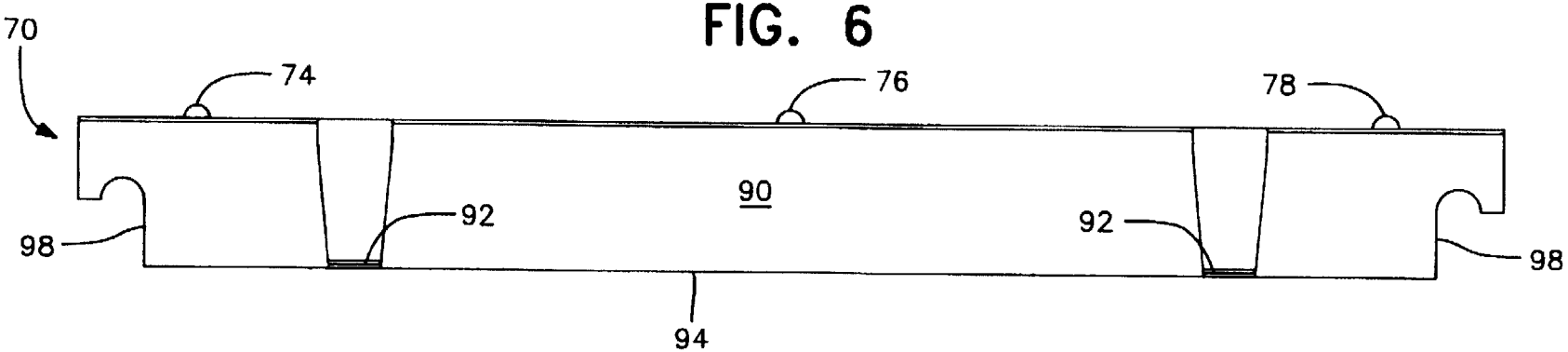
FIG. 6 is a bottom view of the movable slide element.
Figure 7:
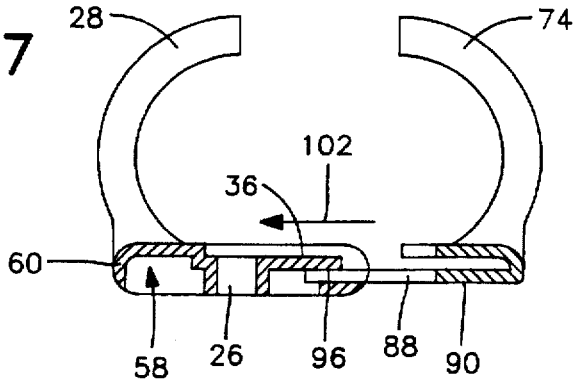
FIG. 7 is a sectional view taken along lines D—D of both FIG. 2 and FIG. 5 with the fixed base and movable slide elements connected together and shown in the extended or open position.
Figure 8:
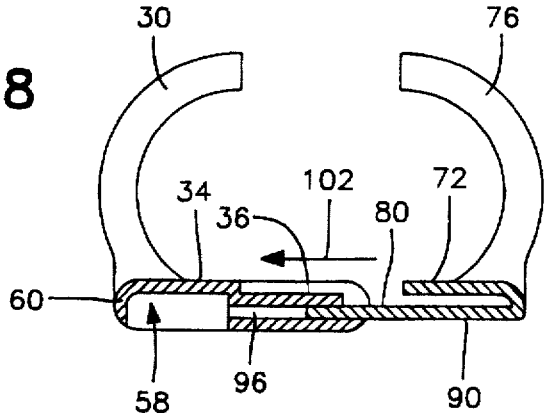
FIG. 8 is a sectional view taken along lines C—C of both FIG. 2 and FIG. 5 with the fixed base and movable slide elements connected together and shown in the extended or open position.

In FIGS. 4 through 6, movable slide element 70 is shown. This is the second piece of the two piece binder assembly of the present invention.

Slide element 70 includes an uppermost surface region 72, from which project integral binder fingers 74, 76, 78. Binder fingers 74, 76, 78 are located to engage with corresponding opposed fingers 28, 30 and 32 of base element 20.

Spaced downwardly from uppermost surface 72 is ledge 80. Projecting upwardly from ledge 80 in the direction of uppermost surface 72, is locking member 82 having ramp 84 leading up to hook edge 86. Ledge 80 and uppermost surface 72 include cutaway areas 88 for fitting around rivets passing through openings 26 in the base element 20.

On the bottom surface 90 of the slide element 70 are projections 92. Projections 92 cooperate with cutouts 52 and particularly stop edges 54 to limit the extent of movement of the slide element 70 with respect to the base element 20.

To assemble the base element 20 and slide element 70 together, the leading side edge 94 formed on the slide element 70 between ledge 80 and lowermost surface 90, is inserted into an opening 96 in the base element 20. The opening 96 is defined above the side edge 56 and below the ledges 36, on the level of track 38, as indicated by cross hatching in FIG. 2. End edges 98 of slide element 70 engage side edges 100 to guide the sides of the slide element 70 into the base element 20.

Figure 9:
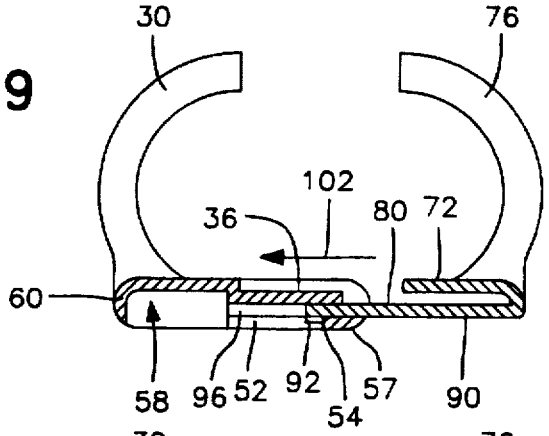
FIG. 9 is a sectional view taken along lines B—B of both FIG. 2 and FIG. 5 with the fixed base and movable slide elements connected together and shown in the extended or open position.
Figure 10:
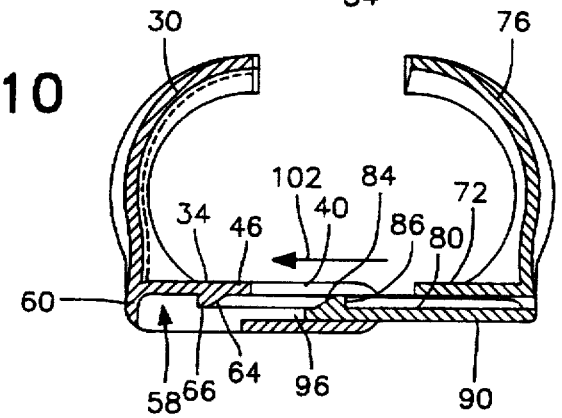
FIG. 10 is a sectional view taken along lines A—A of both FIG. 2 and FIG. 5 with the fixed base and movable slide elements connected together and shown in the extended or open position.

During continuous sliding of the leading side edge 94 of the slide element 70 into the side opening 96 of the base element 20, the projections 92 on the lowermost surface 90 of the slide element 70 are forced past strip 57 until the projections are allowed to snap behind stop edge 54 and into cutouts 52. This position is shown in a sectional view in FIG. 9.

The two elements 20 and 70 are now permanently fixed together in the open position of the binder assembly. This open position of the binder assembly is shown in sectional views in FIGS. 7 through 10.

Upon continued movement of the slide element 70 in a direction perpendicular to a longitudinal axis of the base element 20, in the direction of arrows 102, the leading edge of each of the fingers 74, 76, 78 will approach, meet and interlock with the leading edge of fingers 28, 30, 32. Simultaneously, the ramp 84 of locking member 82 will engage ramp 64 of locking member 62 and be forced by the manual pressure of the slide element 70 moving towards the base element 20 to deflect the platform 46 and locking member 82 upwardly and the locking member 62 on ledge 80 downwardly. This deflection will continue until the hook edges 66 and 86 pass each other, at which point due to the bias force of the resilient plastic material, the two hook edges 66 and 86 will engage each other and form a locked engagement. The base element 20 and the slide element 70 will thereby be locked in a closed position with the opposed pairs of binder fingers engaging each other. Any paper material located on the opposed binder fingers, which now form binder rings, will be held in place.

To release engagement of the base element 20 and slide element 70, the platform 46 including finger 30 will be lifted and pulled in the direction of arrows 44 by manually grasping finger 30 while finger 76 is manually grasped and pulled in the direction of arrows 104. By this movement, the hook edges 66 and 86 are separated from each other and the ramps 64 and 84 will slide over each other to release the engagement of the locking members 62 and 82. Upon continued lateral movement of the slide element 70 in a direction perpendicular to the longitudinal axis of the base element 20, the slide element will be moved with respect to the base element until the projections 92 engage stop edge 54 of the base element 20. At this point, continued lateral movement of the slide element will be prevented. The binder assembly of the present invention is now in an open position for adding or removing paper or other materials placed around the open sets of opposed binder fingers.

To close the binder assembly, the slide element 70 is moved towards the base element 20 in a direction perpendicular to the longitudinal axis of the base element 20 until the locking members 62 and 82 engage each other and secure or lock the two elements together. The natural tendency of the temporarily deformed plastic elements to revert to their original formed position provides a long work life to this product.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A binder assembly comprising:

a base element including a plurality of binder fingers, a slide element including a plurality of binder fingers, said slide element being slidably mounted on said base element to move in a direction perpendicular to a longitudinal axis of said base element between an open position and a closed position, said base element and said slide element including cooperating surfaces to maintain said base element in said closed position and to limit separation of said base element and said slide element in said open position, and at least one of said binder fingers of said base element and said slide element being movable to release said base element and said slide element to move to said open position.

2. A binder assembly as claimed in claim 1, wherein said binder fingers of said base element and said binder fingers of said slide element engage each other in said closed position.

3. A binder assembly as claimed in claim 1, wherein said base element and said slide element are made of plastic.

4. A binder assembly as claimed in claim 1, wherein said base element and said slide element include cooperating locking elements which lock said base element and said slide element together when said base element and said slide element are in said closed position.

5. A binder assembly as claimed in claim 1, wherein said base element includes two rivet holes.

6. A binder assembly as claimed in claim 1, wherein all of said binder fingers on said base element face one direction.

7. A binder assembly as claimed in claim 6, wherein all of said binder fingers on said slide element face in one direction, said one direction of said binder fingers of said slide element being opposite to said one direction of said binder fingers of said base element.

8. A binder assembly as claimed in claim 1, wherein said binder fingers of said base element are integral with said base element and said binder fingers of said slide element are integral with said slide element.

9. A binder assembly comprising:

a base element, a slide element slidably mounted on said base element to move laterally with respect to a longitudinal axis of said base element between an open position and a closed position, said base element and said slide element including cooperating surfaces to maintain said base element in said closed position and to limit separation of said base element and said slide element in said open position, and at least one portion of said base element and said slide element being movable to release said base element and said slide element to move to said open position.

10. A binder assembly as claimed in claim 9, wherein binder fingers of said base element and binder fingers of said slide element engage each other in said closed position.

11. A binder assembly as claimed in claim 9, wherein said base element and said slide element are made of plastic.

12. A binder assembly as claimed in claim 9, wherein said base element and said slide element include cooperating locking elements which lock said base element and said slide element together when said base element and said slide element are in said closed position.

13. A binder assembly as claimed in claim 9, wherein said base element includes two rivet holes.

14. A binder assembly as claimed in claim 9, wherein binder fingers on said base element face one direction.

15. A binder assembly as claimed in claim 14, wherein binder fingers on said slide element face in one direction, said one direction of said binder fingers of said slide element being opposite to said one direction of said binder fingers of said base element.

16. A binder assembly as claimed in claim 9, wherein binder fingers of said base element are integral with said base element and binder fingers of said slide element are integral with said slide element.

* * * * *